US008621765B2

(12) United States Patent
Geer et al.

(10) Patent No.: US 8,621,765 B2
(45) Date of Patent: Jan. 7, 2014

(54) MOLDED INSOLE FOR WELTED FOOTWEAR

(75) Inventors: Kenton Donald Geer, Red Wing, MN (US); David Ralph Swinnerton, Red Wing, MN (US)

(73) Assignee: Red Wing Shoe Company, Inc., Red Wing, MN (US)

( * ) Notice: Subject to any disclaimer, the term of this patent is extended or adjusted under 35 U.S.C. 154(b) by 577 days.

(21) Appl. No.: 12/634,088

(22) Filed: Dec. 9, 2009

(65) Prior Publication Data

US 2010/0139121 A1 Jun. 10, 2010

Related U.S. Application Data

(60) Provisional application No. 61/121,072, filed on Dec. 9, 2008.

(51) Int. Cl.
*A43B 9/04* (2006.01)

(52) U.S. Cl.
USPC ..... 36/12; 36/17 R; 36/21

(58) Field of Classification Search
USPC ..... 36/12, 17 R, 17 PW, 18, 21, 22 R, 22 A
See application file for complete search history.

(56) References Cited

U.S. PATENT DOCUMENTS 1,354,972 A * 10/1920 Hess ..... 36/17 R
1,656,564 A 1/1928 Lyon
1,687,459 A 10/1928 Lyon
1,687,460 A 10/1928 Lyon
1,854,183 A 4/1932 Fallon, Jr.
1,911,956 A 5/1933 Jennings
1,961,345 A 6/1934 Fallon, Jr.
2,004,116 A 6/1935 Jennings
2,004,117 A 6/1935 Jennings
2,084,874 A * 6/1937 Sutcliffe ..... 36/17 R
2,138,396 A 11/1938 Brown
2,201,382 A * 5/1940 Vizard ..... 36/78
2,201,383 A * 5/1940 Vizard ..... 36/17 R
2,204,505 A * 6/1940 Lumbard ..... 36/22 A
2,219,947 A 10/1940 Vizard
2,235,087 A * 3/1941 Smith ..... 36/17 R
2,275,574 A 3/1942 Vizard
2,351,323 A * 6/1944 Daniels et al. ..... 36/145
2,403,750 A 7/1946 Ouimet
2,408,650 A 10/1946 Jennings
2,429,255 A * 10/1947 Ashley ..... 36/19.5
2,700,231 A 1/1955 Vizard
2,754,600 A 7/1956 Vizard
2,916,834 A 12/1959 Shea
3,034,235 A * 5/1962 Hunting et al. ..... 36/77 R
3,064,368 A 11/1962 Daniels
3,304,630 A 2/1967 Sherbrook
3,414,988 A 12/1968 Mattos
3,561,141 A 2/1971 Brown
3,591,882 A 7/1971 Pearsall (Continued)

OTHER PUBLICATIONS

International Search Report and Written Opinion mailed Jul. 21, 2010.

*Primary Examiner* — Marie Patterson
(74) *Attorney, Agent, or Firm* — Merchant & Gould P.C.

(57) ABSTRACT

The present disclosure provides an improved welted footwear and related method of manufacture. The welted footwear and related method of manufacturing is directed to a molded foot support platform that provides a number of advantageous features.

17 Claims, 12 Drawing Sheets

(56) References Cited

U.S. PATENT DOCUMENTS 3,594,929 A 7/1971 Stohr
3,766,669 A 10/1973 Pearsall
4,079,526 A 3/1978 Fukuoka
4,128,950 A 12/1978 Bowerman et al.
4,182,055 A 1/1980 Turner, Jr.
4,187,621 A 2/1980 Cohen
4,231,169 A 11/1980 Toyama et al.
4,255,874 A 3/1981 Sironi
4,316,332 A 2/1982 Giese et al.
4,348,821 A 9/1982 Daswick
4,366,634 A 1/1983 Giese
4,402,146 A 9/1983 Parracho et al.
4,404,702 A 9/1983 Clayman et al.
4,439,936 A 4/1984 Clarke et al.
4,501,077 A 2/1985 Young
4,503,576 A 3/1985 Brown
4,506,460 A 3/1985 Rudy
4,541,184 A 9/1985 Leighton
4,541,186 A 9/1985 Mulvihill
4,547,979 A 10/1985 Harada et al.
4,557,060 A 12/1985 Kawashima
4,586,273 A 5/1986 Chapnick
4,590,123 A 5/1986 Hashimoto et al.
4,594,283 A 6/1986 Ohigashi
4,602,442 A 7/1986 Revill et al.
4,608,768 A 9/1986 Cavanagh
4,667,423 A 5/1987 Autry et al.
4,674,205 A 6/1987 Anger
4,676,010 A 6/1987 Cheskin
4,694,589 A 9/1987 Sullivan et al.
4,716,662 A 1/1988 Bar
4,730,402 A 3/1988 Norton et al.
4,769,926 A 9/1988 Meyers
4,823,483 A 4/1989 Chapnick
4,825,624 A 5/1989 Calcerano
4,870,762 A * 10/1989 Lee ..... 36/77 R
4,882,856 A 11/1989 Glancy
4,893,418 A 1/1990 Ogden
4,897,937 A 2/1990 Misevich et al.
4,908,964 A 3/1990 Deem
4,910,882 A 3/1990 Goller
4,910,886 A 3/1990 Sullivan et al.
4,930,232 A 6/1990 Engle
4,931,773 A 6/1990 Rosen
4,932,141 A 6/1990 Hones
4,942,679 A 7/1990 Brandon et al.
4,977,691 A 12/1990 Orchard, III
4,979,318 A 12/1990 Cohen
4,999,237 A 3/1991 Mellors et al.
5,007,184 A * 4/1991 Lee ..... 36/77 R
5,014,041 A 5/1991 Rosen
5,068,983 A 12/1991 Marc
5,146,698 A 9/1992 Tilles et al.
5,152,081 A 10/1992 Hallenbeck et al.
5,170,572 A 12/1992 Kantro
5,191,727 A 3/1993 Barry et al.
5,203,096 A 4/1993 Rosen
5,203,793 A 4/1993 Lyden
5,233,769 A 8/1993 Weber
5,285,583 A 2/1994 Aleven
5,311,677 A 5/1994 Mann et al.
5,339,544 A 8/1994 Caberlotto
5,362,435 A 11/1994 Volpe
5,390,430 A 2/1995 Fitchmun
5,435,077 A 7/1995 Pyle
5,435,078 A 7/1995 Pyle
5,469,639 A 11/1995 Sessa
5,542,195 A 8/1996 Sessa
5,542,196 A 8/1996 Kantro
5,607,745 A 3/1997 Ogden
5,714,229 A 2/1998 Ogden
5,718,064 A 2/1998 Pyle
5,727,336 A 3/1998 Ogden
5,732,429 A 3/1998 Strickland
5,761,832 A 6/1998 George
5,786,057 A 7/1998 Lyden et al.
5,787,609 A 8/1998 Wu
5,881,478 A 3/1999 McMahon et al.
5,906,872 A 5/1999 Lyden et al.
5,933,982 A 8/1999 Chen
5,974,697 A * 11/1999 Tseng ..... 36/77 R
6,038,790 A 3/2000 Pyle et al.
6,050,001 A 4/2000 Ditrtrich
6,061,929 A 5/2000 Ritter
6,108,943 A 8/2000 Hudson et al.
6,120,880 A 9/2000 Crow
6,226,895 B1 5/2001 McClelland
6,282,816 B1 9/2001 Rosendahl
6,286,232 B1 9/2001 Snyder et al.
6,301,805 B1 10/2001 Howlett et al.
6,408,543 B1 6/2002 Erickson et al.
6,477,792 B2 11/2002 Sartor
6,505,420 B1 1/2003 Litchfield et al.
6,578,290 B1 6/2003 Meynard
6,589,630 B1 7/2003 Crow
6,598,319 B2 7/2003 Hardt
6,598,321 B2 7/2003 Crane et al.
6,601,319 B1 * 8/2003 Clements ..... 36/17 R
6,631,568 B2 10/2003 Howlett et al.
6,647,646 B2 11/2003 Mitsui et al.
6,684,532 B2 2/2004 Greene et al.
6,699,028 B2 3/2004 Davis et al.
6,802,138 B2 * 10/2004 McManus et al. ..... 36/28
6,880,266 B2 4/2005 Schoenborn et al.
6,920,707 B1 7/2005 Greene et al.
6,931,763 B2 8/2005 Bray, Jr. et al.
6,944,975 B2 9/2005 Safdeye et al.
6,990,754 B2 1/2006 Bray, Jr. et al.
7,013,583 B2 3/2006 Greene et al.
7,017,285 B2 3/2006 Lakic
7,082,704 B2 8/2006 Throneburg et al.
7,096,604 B2 8/2006 Moretti
7,107,705 B2 9/2006 Dalton et al.
7,140,126 B2 11/2006 Crane et al.
7,210,250 B2 5/2007 Gallegos
7,243,443 B2 7/2007 Swigart
7,249,425 B2 7/2007 Wang
7,254,907 B2 8/2007 Nishiwaki
7,278,226 B2 10/2007 Holden et al.
7,284,342 B2 10/2007 Avent et al.
7,331,125 B2 2/2008 Bray, Jr. et al.
7,373,739 B2 5/2008 Doerer et al.
7,380,353 B2 6/2008 Feller et al.
7,383,647 B2 6/2008 Chan et al.
7,392,604 B2 7/2008 Greene et al.
7,421,808 B2 9/2008 Baier et al.
2001/0016991 A1 8/2001 Sartor
2001/0022041 A1 9/2001 Gebhard
2001/0032397 A1 10/2001 Ho
2001/0032400 A1 10/2001 Brooks
2001/0045028 A1 11/2001 Crane et al.
2002/0007569 A1 1/2002 Crane et al.
2002/0017039 A1 2/2002 Hines
2002/0050078 A1 5/2002 Dietrich et al.
2002/0083618 A1 7/2002 Erickson et al.
2002/0092203 A1 7/2002 Hardt
2002/0166259 A1 11/2002 Crane et al.
2002/0166261 A1 11/2002 Safdeye et al.
2003/0005599 A1 1/2003 Panaccione
2003/0009915 A1 1/2003 Bacon
2003/0024134 A1 2/2003 Howlett et al.
2003/0056397 A1 3/2003 Hsiao
2003/0061736 A1 4/2003 Polifroni
2003/0070321 A1 4/2003 Davis et al.
2003/0093920 A1 5/2003 Greene et al.
2003/0101620 A1 6/2003 Reed et al.
2003/0115776 A1 6/2003 Chu
2003/0121177 A1 * 7/2003 Lee ..... 36/17 R
2003/0140524 A1 7/2003 Robinson, Jr. et al.
2003/0150131 A1 8/2003 McManus et al.
2003/0150134 A1 8/2003 Hardt
2003/0172548 A1 9/2003 Fuerst
2003/0200678 A1 10/2003 Nishiwaki et al.
2003/0226282 A1 12/2003 Ho et al.

(56) References Cited

U.S. PATENT DOCUMENTS

| | | | | |
|---|---|---|---|---|
| 2004/0003513 | A1 | 1/2004 | Crane et al. | |
| 2004/0020078 | A1 | 2/2004 | Bray et al. | |
| 2004/0020080 | A1 | 2/2004 | Cox et al. | |
| 2004/0025376 | A1 | 2/2004 | Grisoni et al. | |
| 2004/0064973 | A1 | 4/2004 | Talbott | |
| 2004/0078998 | A1 | 4/2004 | Davis et al. | |
| 2004/0118017 | A1 | 6/2004 | Dalton et al. | |
| 2004/0123495 | A1 | 7/2004 | Greene et al. | |
| 2004/0134095 | A1 | 7/2004 | Bray et al. | |
| 2004/0187347 | A1* | 9/2004 | Wu | 36/18 |
| 2004/0194351 | A1 | 10/2004 | Gallegos | |
| 2004/0216330 | A1 | 11/2004 | Swigart | |
| 2005/0000115 | A1 | 1/2005 | Kimura et al. | |
| 2005/0000116 | A1 | 1/2005 | Snow | |
| 2005/0022425 | A1 | 2/2005 | Brown | |
| 2005/0044751 | A1 | 3/2005 | Alaimo | |
| 2005/0086838 | A1 | 4/2005 | Khantzis | |
| 2005/0115107 | A1 | 6/2005 | Schumacher | |
| 2005/0160626 | A1 | 7/2005 | Townsend | |
| 2005/0229431 | A1 | 10/2005 | Gerlin | |
| 2005/0262736 | A1 | 12/2005 | Peoples | |
| 2006/0010716 | A1 | 1/2006 | Kerns et al. | |
| 2006/0021251 | A1 | 2/2006 | Swigart et al. | |
| 2006/0021252 | A1 | 2/2006 | Throneburg et al. | |
| 2006/0026865 | A1 | 2/2006 | Grisoni et al. | |
| 2006/0075658 | A1 | 4/2006 | Mitchell | |
| 2006/0130364 | A1 | 6/2006 | Greene et al. | |
| 2006/0130366 | A1 | 6/2006 | Bray et al. | |
| 2006/0156581 | A1 | 7/2006 | Holden et al. | |
| 2006/0213081 | A1 | 9/2006 | Geer et al. | |
| 2006/0213083 | A1 | 9/2006 | Nishiwaki | |
| 2006/0218819 | A1 | 10/2006 | Wu | |
| 2006/0277796 | A1 | 12/2006 | Gallegos | |
| 2007/0017123 | A1 | 1/2007 | Scofield et al. | |
| 2007/0022630 | A1 | 2/2007 | Lundy, Jr. et al. | |
| 2007/0028484 | A1 | 2/2007 | Akhidime | |
| 2007/0028485 | A1 | 2/2007 | Crane | |
| 2007/0033832 | A1 | 2/2007 | Marvin | |
| 2007/0033834 | A1 | 2/2007 | Cheskin | |
| 2007/0033835 | A1 | 2/2007 | Bray, Jr. | |
| 2007/0079532 | A1 | 4/2007 | Ramirez | |
| 2007/0101612 | A1 | 5/2007 | Kilgore | |
| 2007/0180632 | A1* | 8/2007 | Gallegos | 12/146 B |
| 2007/0204484 | A1 | 9/2007 | Davis | |
| 2007/0234593 | A1 | 10/2007 | Beck | |
| 2007/0245594 | A1 | 10/2007 | Kim | |
| 2007/0271820 | A1 | 11/2007 | Nurse et al. | |
| 2007/0289170 | A1 | 12/2007 | Avent et al. | |
| 2007/0294916 | A1 | 12/2007 | Park | |
| 2007/0295451 | A1 | 12/2007 | Willis | |
| 2008/0010857 | A1 | 1/2008 | Green | |
| 2008/0010861 | A1 | 1/2008 | Kosmas | |
| 2008/0034614 | A1 | 2/2008 | Fox et al. | |
| 2008/0040952 | A1 | 2/2008 | Celia | |
| 2008/0086909 | A1 | 4/2008 | Raspini | |
| 2008/0086980 | A1 | 4/2008 | Martin | |
| 2008/0092406 | A1 | 4/2008 | Ludemann | |
| 2008/0110064 | A1 | 5/2008 | Liu | |
| 2008/0141562 | A1 | 6/2008 | Peveto | |
| 2008/0155858 | A1 | 7/2008 | Bray et al. | |

* cited by examiner

MOLDED INSOLE FOR WELTED FOOTWEAR

RELATED APPLICATIONS

This application claims priority to provisional application No. 61/121,072 filed on Dec. 9, 2008, which is hereby incorporated by reference in its entirety.

TECHNICAL FIELD

The present disclosure provides welted footwear and a method of manufacturing the same.

BACKGROUND

Footwear having welted constructions are well known. For example, see U.S. Pat. No. 1,656,564 titled Welting and Method of Making the Same, U.S. Pat. No. 2,754,600 titled Shoe Welting, and U.S. Pat. No. 6,802,138 titled Cushioning System for Footwear and Related Method of Manufacture. Though traditional welted type constructions are known and have been improved upon, further improvements in welted footwear are desirable.

SUMMARY

The present disclosure provides an improved welted footwear and related method of manufacture. The welted footwear and related method of manufacturing is directed to a foot support platform that provides a number of advantageous features. Toe cap features are also provided.

DETAILED DESCRIPTION

An embodiment of an article of footwear in accordance with the principles of the present disclosure is described herein with reference to the figures. In the depicted embodiment the footwear is a boot 10 having a welted construction. It should be appreciated that the article of footwear according to the principles of the present disclosure is applicable to many different types of welted footwear (e.g., dress shoes, athletic shoes, winter boots, sandals, hiking boots, etc.).

Figure 1:
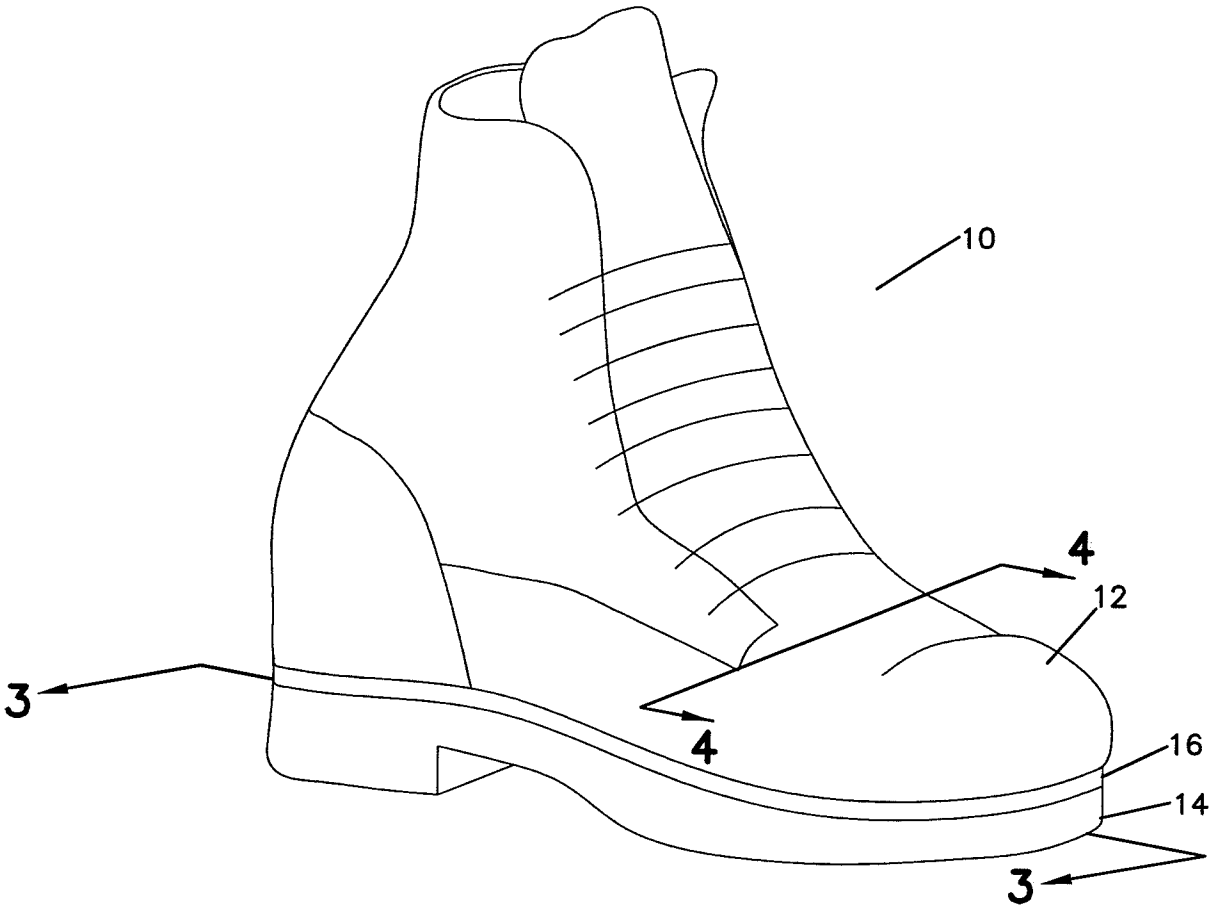
FIG. 1 is a perspective view of an article of footwear according to an embodiment of the present disclosure.
Figure 2:
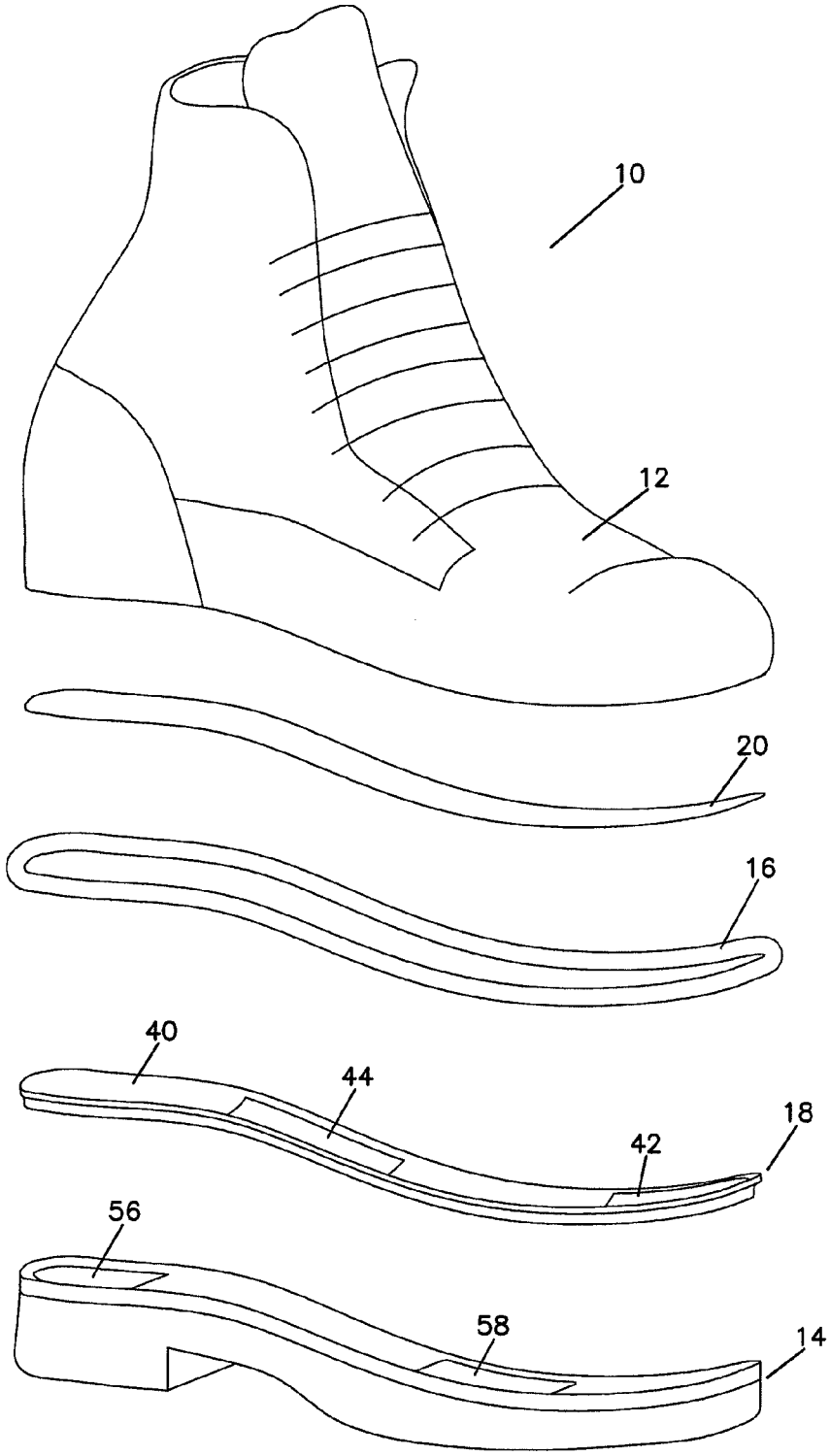
FIG. 2 is an exploded perspective view of the footwear of FIG. 1.
Figure 3:
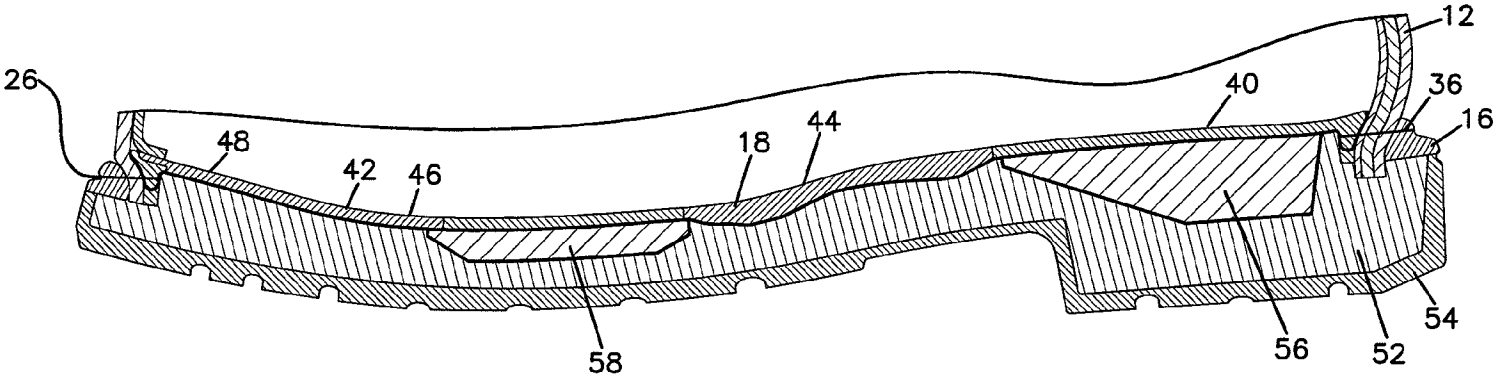
FIG. 3 is a sectional view of the footwear taken along line 3-3 of FIG. 1.
Figure 4:
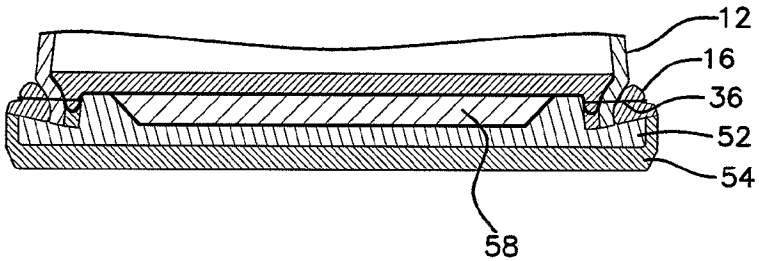
FIG. 4 is a sectional view of the footwear taken along line 4-4 of FIG. 1.
Figure 5:
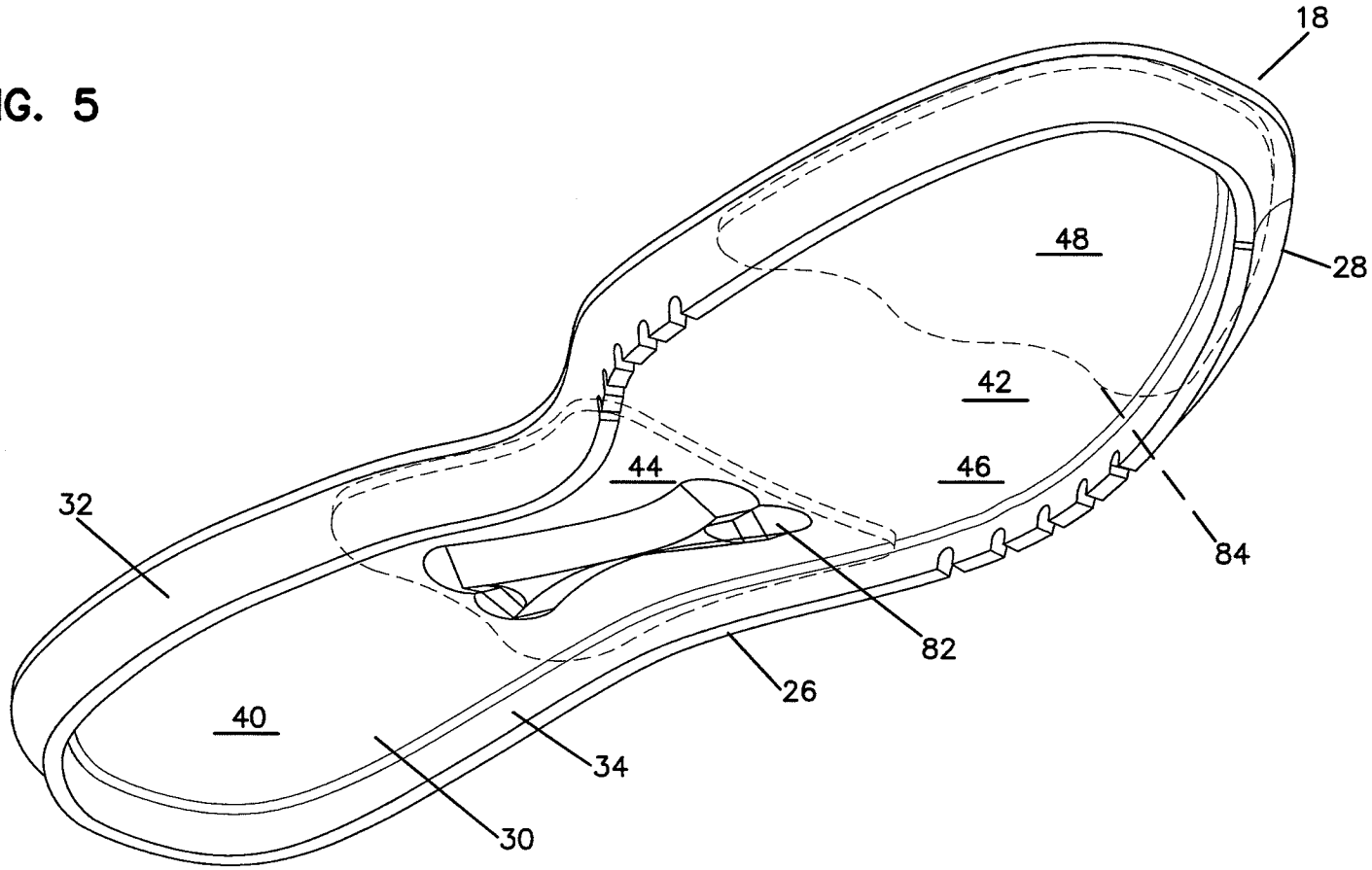
FIG. 5 is a bottom perspective view of a foot support platform of the footwear of FIG. 1.
Figure 6:
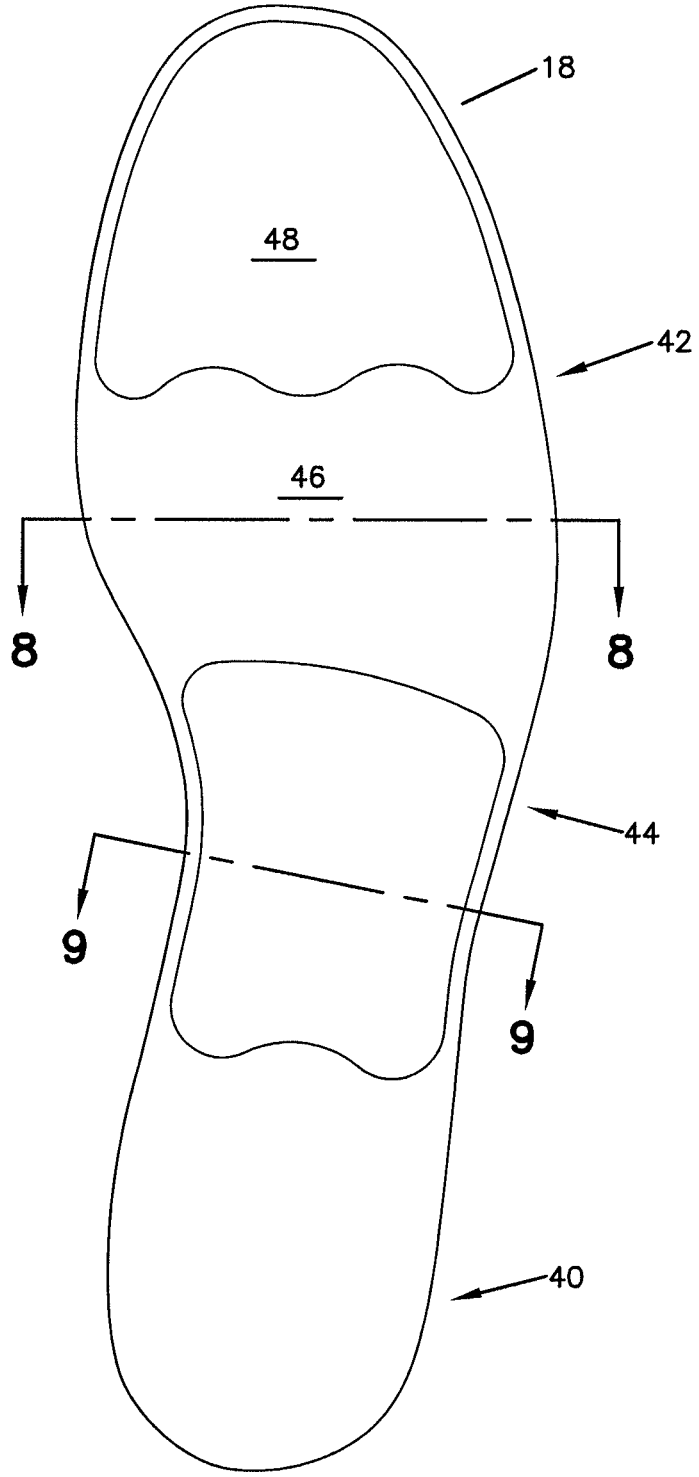
FIG. 6 is a top view of the foot support platform of the footwear of FIG. 1.
Figure 7:
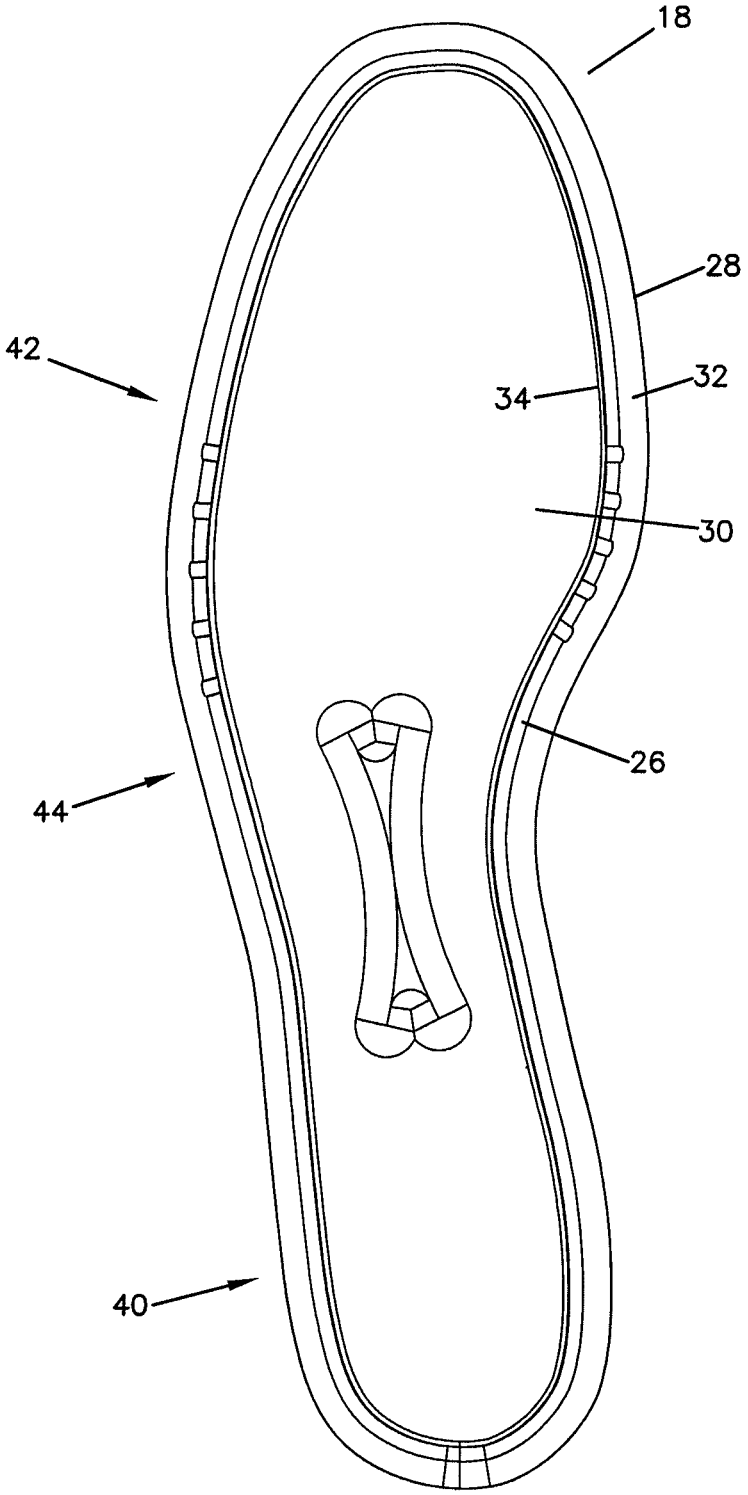
FIG. 7 is a bottom view of the foot support platform of the footwear of FIG. 1.
Figure 8:
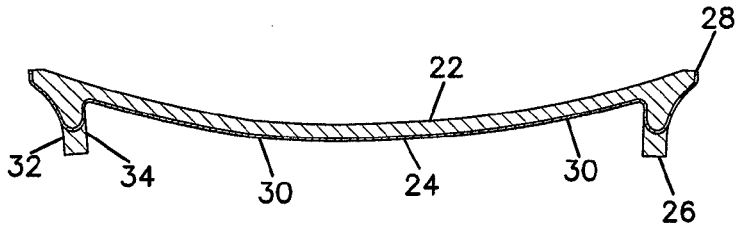
FIG. 8 is a sectional view of the foot support platform taken along line 8-8 of FIG. 6.

Referring to FIG. 1, the boot 10 includes an upper portion 12 connected to an outsole 14 via a welt 16. The upper portion 12 of an article of footwear is configured to hold the outsole 14 to a foot. In the depicted embodiment the upper portion 12 is also configured to protect a foot and an ankle of the person wearing the boot. In the depicted embodiment the upper portion 12 is constructed of leather. Many other materials can also be used in the construction of the upper portion 12 (e.g., canvas, nylon, etc.).

The outsole 14 is configured to engage the ground surface. In particular, the outsole 14 in the depicted embodiment includes a bottom surface 54 that is configured to contact the ground surface. In the depicted embodiment the bottom surface 54 includes a tread surface that provides grip. In the depicted embodiment the outsole includes a shock absorbing material (e.g., soft rubber, foam, gel, etc.) that is molded to the bottom surface 54. In alternative embodiments, the shock absorbing material may be the same material that contacts the ground surface. Also, it should be appreciated that the outsole can also include stiff material such as wood, plastic, metal or a combination of materials to provide auxiliary support in the midfoot portion of the footwear. The construction of the outsole 14 is described in greater detail below.

Referring to FIGS. 2-10, an exploded assembly view the boot 10 is shown. The boot 10 includes a foot support platform 18 that is connected to the welt 16 and the outsole 14. In some embodiments the foot support platform 18 supports a removable foot bed cushion 20, which contacts the user's foot. In other embodiments the user's foot directly contacts the foot support platform 18 or non-removable (e.g., stitched and/or cemented) foot bed cushion materials are provided over the foot support platform 18. In the depicted embodiment the foot support platform 18 includes a first surface 22 (an upper surface) and a second surface 24 (a lower surface). The foot support platform 18 includes a downwardly extending rib 26 which extends from the second surface adjacent a periphery edge 28 of the foot support platform 18. In the depicted embodiment the rib 26 includes an outer side wall 32 that is radiused to the periphery edge 28 and an inner side wall 34 that is generally vertical. The shape of the outer side wall 32 minimizes or eliminates the gaps between the upper portion 12 and the rib 26 where they are stitched together.

In the depicted embodiment the foot support platform 18 is molded and the rib 26 is integrally molded to the foot support platform 18. In the depicted embodiment a pliable material 30 (e.g., fabric) is molded to the second surface 24 and to a portion of the rib 26. The pliable material 30 can be any material that can make the rib 26 more tear resistance when molded thereto (e.g., a pliable material made by weaving, felting, knitting). It should be appreciated that the pliable material can be a fabric made of natural fibers, synthetic fibers, or a combination of natural and synthetic fibers.

In the depicted embodiment, the pliable material 30 is molded through a portion of the rib 26 such that a portion of the lower portion of the rib 26 is on one side of the pliable material 30, and another portion of the rib 26 is on the other side of the fabric material. In the depicted embodiment the pliable material 30 is present on both the inner side wall 34 and the outer side wall 32 of the rib 26. The pliable material provides the rib 26 improved tear resistance. In the depicted embodiment, the pliable material 30 is placed in a mold and polymeric molten material is molded to the pliable material 30. In the area of the rib 26 the molten material is molded through the pliable material 30, which results in portions of the rib 26 being on either side of the pliable material 30. It should be appreciated that in alternative embodiments, the fabric 30 is molded over the rib 26 such that the fabric covers the rib 26 rather than extending through the rib 26 as depicted.

In the depicted embodiment the welt 16 is stitched to a lower periphery edge of the upper portion 12 and to the rib 26. In the depicted embodiment the stitches 36 that connect the welt to the upper portion and rib extend through the pliable material on both an inner side wall 34 and an outer side wall 32 portion of the rib 26. In the depicted embodiment, the stitches 36 extend through two layers of the pliable material 30 when the stitch extends through the zone 53 of the rib 26, which is shown between the dashed lines in FIG. 10. This configuration prevents separation due to the rib 26 tearing away from the foot support platform 18 due to stress applied to the rib 26 via the stitches. It should be appreciated that in some embodiments the stitches do not extend through both layers of the pliable material. In some embodiments the stitches extend through only one layer of pliable material and in other embodiments the stitches extend through no layers of pliable material.

In the depicted embodiment the welt 16 is molded to the outsole 14. The connection between the welt 16 and the outsole 14 does not include stitches. However, it should be appreciated that in alternative embodiments the welt 16 can be connected to the outsole with stitches (e.g., the welt can be stitched to a midsole structure that is cemented to the outsole). In addition, in the depicted embodiment the welt 16 includes a flexible construction with a generally T-shaped cross-sectional profile. However, it should be appreciated that the welt can have many alternative configurations. For example, the welt 16 could be constructed of leather and have a generally L-shaped cross-sectional profile, the welt could include a nylon construction with a generally triangular cross-sectional profile, etc.

In the depicted embodiment the foot support platform 18 includes a hindfoot zone 40, a forefoot zone 42, and a midfoot zone 44. The forefoot zone 42 includes a metatarsal support area 46 and a toe support area 48. The hindfoot zone 40 supports a person's heel, the midfoot zone 44 support a person's midfoot, the forefoot zone 42 support a person's forefoot, the metatarsal support area 46 of the forefoot zone 42 supports a person's metatarsals, and the toe support area 48 of the forefoot zone 42 supports a person's toes.

In the depicted embodiment the foot support platform 18 is substantially stiffer in the midfoot zone 44 than the hindfoot zone 40. A relatively stiff material (e.g., glass reinforced nylon) is molded into the midfoot zone 44 of the support platform 18 to provide additional support in the midfoot zone 44. This added stiffness provides many advantages, including minimizing fatigue when the person wearing the boot 10 is standing on a ladder rung. The added stiffness in the midfoot zone 44 can avoid the need to provide a separate shank member in the outsole 14.

In the depicted embodiment the hindfoot zone 40 includes a resilient pliable construction that allows a person's heel to press into the shock absorption materials in a heel area 56 of the outsole 14. In the depicted embodiment, the hindfoot zone 40 is pliable and conforms to the shape of the person's heel in use, thereby avoiding pressure points and hot spots in the heel area.

In the depicted embodiment the toe support area 48 of the foot support platform 18 is substantially stiffer than the metatarsal support area 46. Conversely, the metatarsal support area 46 is more flexible than the midfoot zone 44 of the support platform 18.

Figure 14:
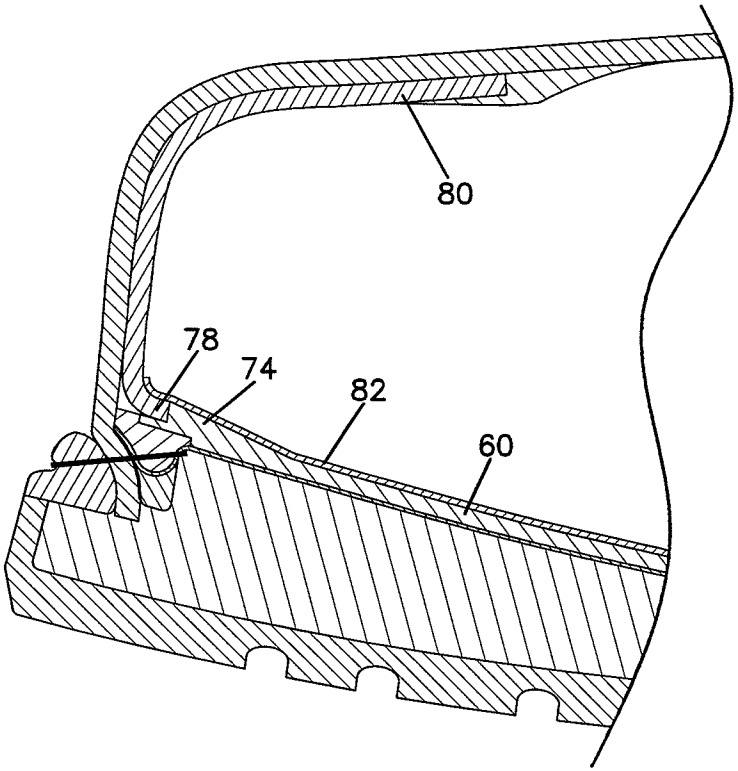
FIG. 14 is a sectional view of a footwear including a toe cap.
Figure 16:
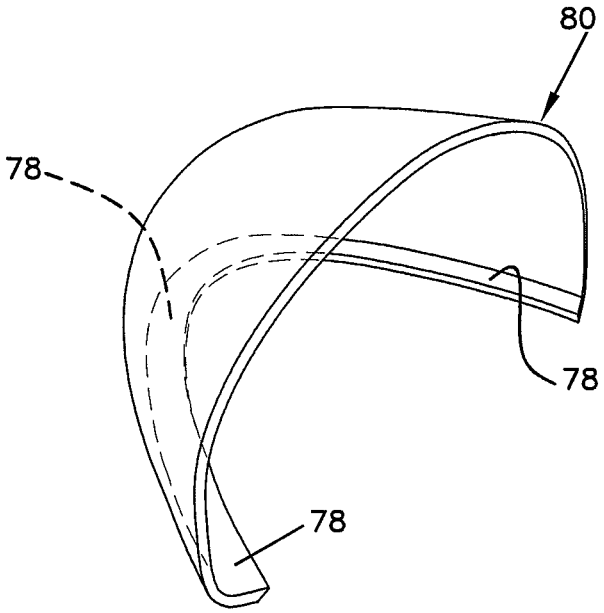
FIG. 16 is a perspective view of a toe cap.

The relative flexibility in the metatarsal support area 46 enables the person to easily flex the shoe when walking, while the stiffness in the toe support area 48 provides a platform for support for a protective toe covering (FIGS. 14 and 16). The flexibility also allows shock to be transferred to and be absorbed by the shock absorption materials in the forefoot area 58 of the outsole 14. In the depicted embodiment, the metatarsal support area 46 is pliable and conforms to the shape of the person's foot, thereby avoiding pressure points and hot spots in the metatarsal area. In the depicted embodiment the rib 26 is notched in the metatarsal support area to provide added flexibility.

The relative stiffness in the toe support area 48 provides axial support for a protective toe coverings (e.g., steel covering) common in work boots. When the protective toe covering is pressed downward, the force is transferred onto the stiffer toe support area 48, which distributes the force down to a relatively large area of the outsole 14. The above-described configuration prevents the toe covering from substantially sinking down into the outsole 14 when impacted, and thereby helps to maintain a relatively constant vertical space in the toe box of the boot 10 when in use.

Figure 9:
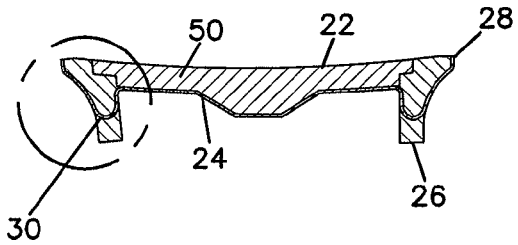
FIG. 9 is a sectional view of the foot support platform taken along line 9-9 of FIG. 6.
Figure 10:
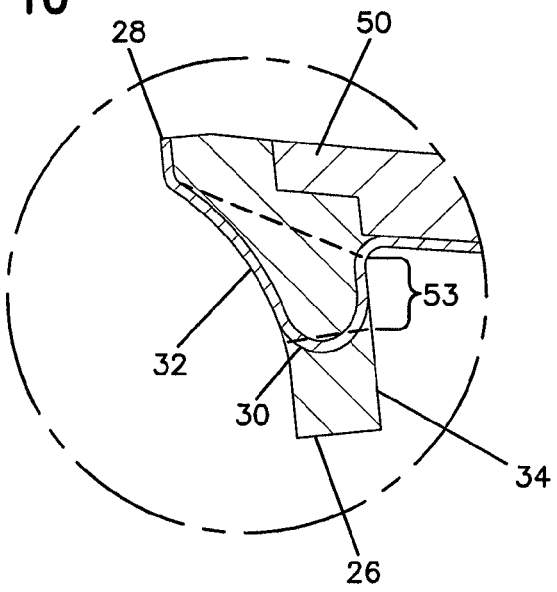
FIG. 10 is an enlarged view of a portion of FIG. 9.
Figure 11:
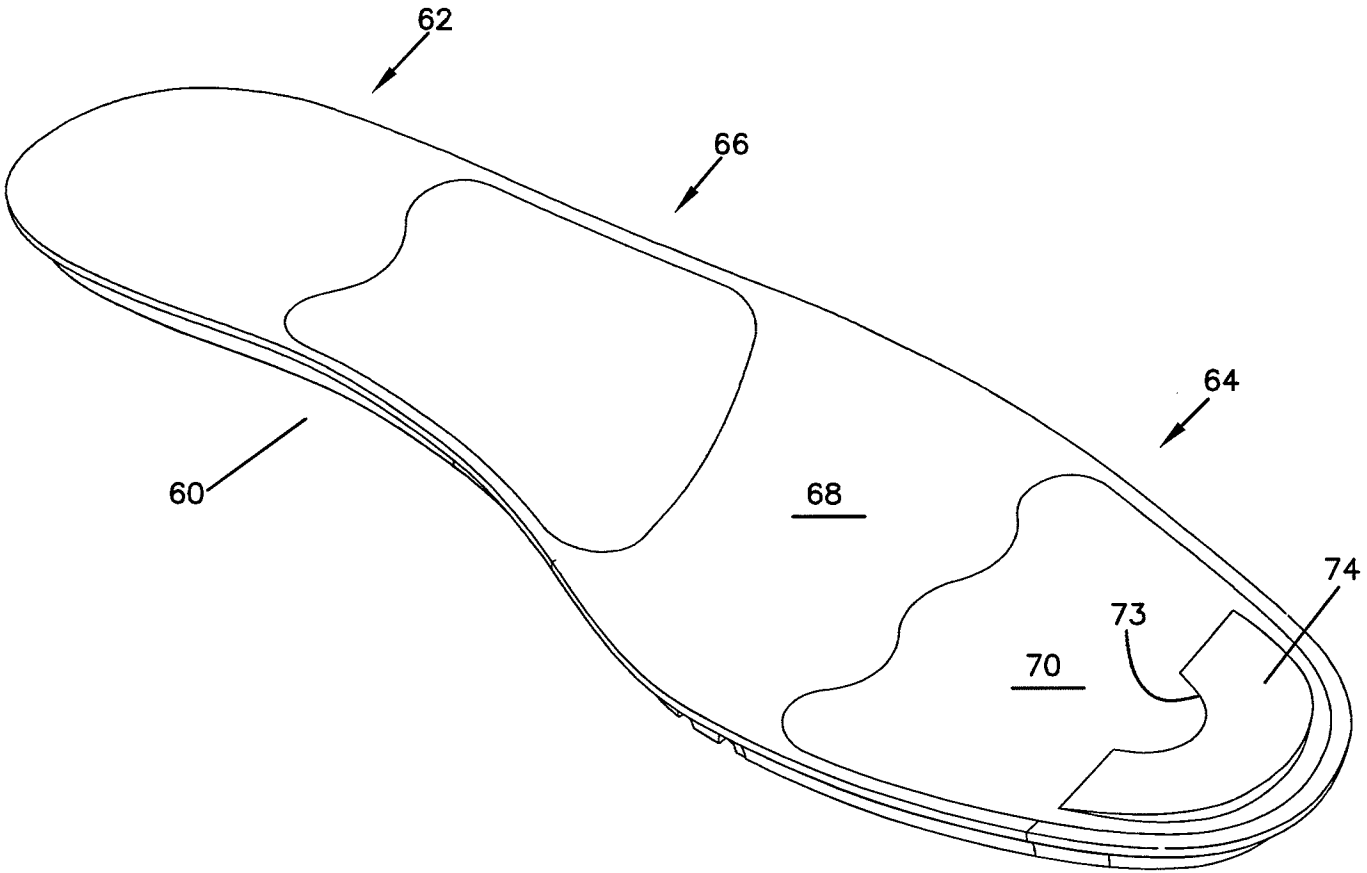
FIG. 11 is a top perspective view of an alternative embodiment of the foot support platform.
Figure 12:
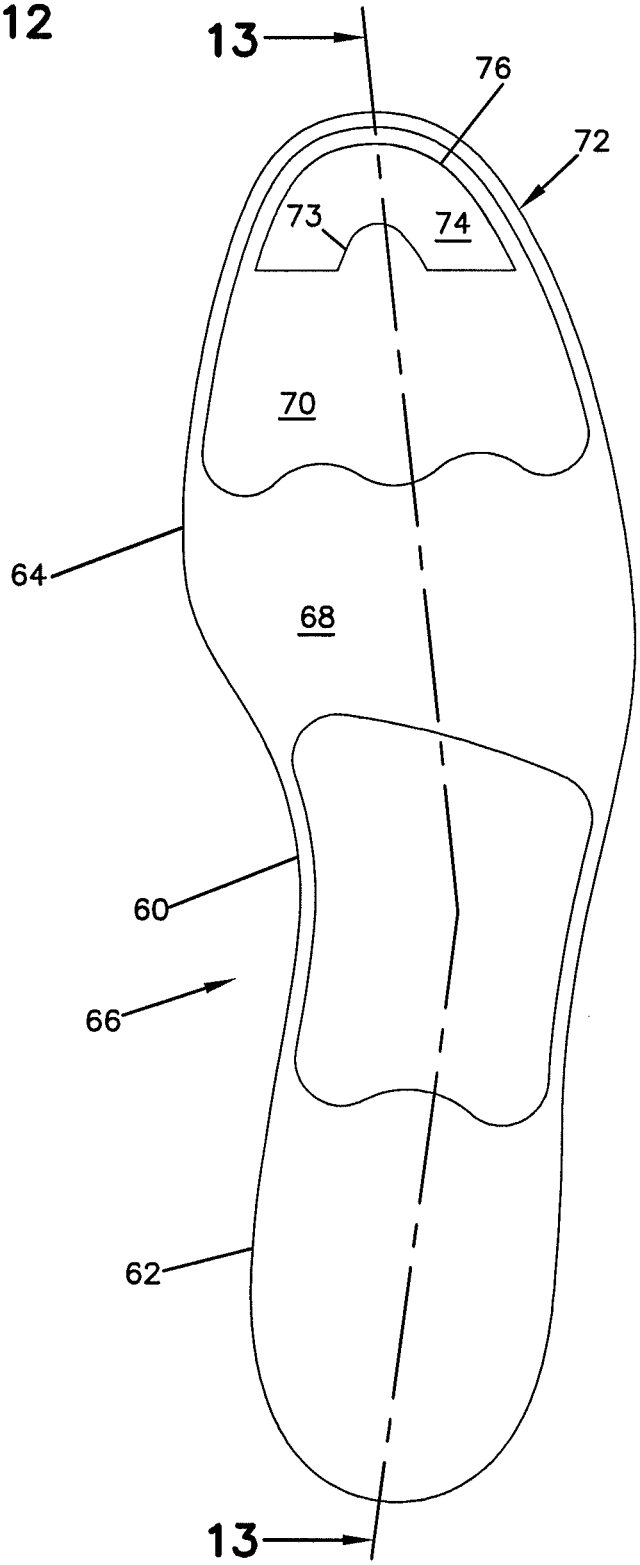
FIG. 12 is a top view of the foot support platform of FIG. 11.
Figure 13:
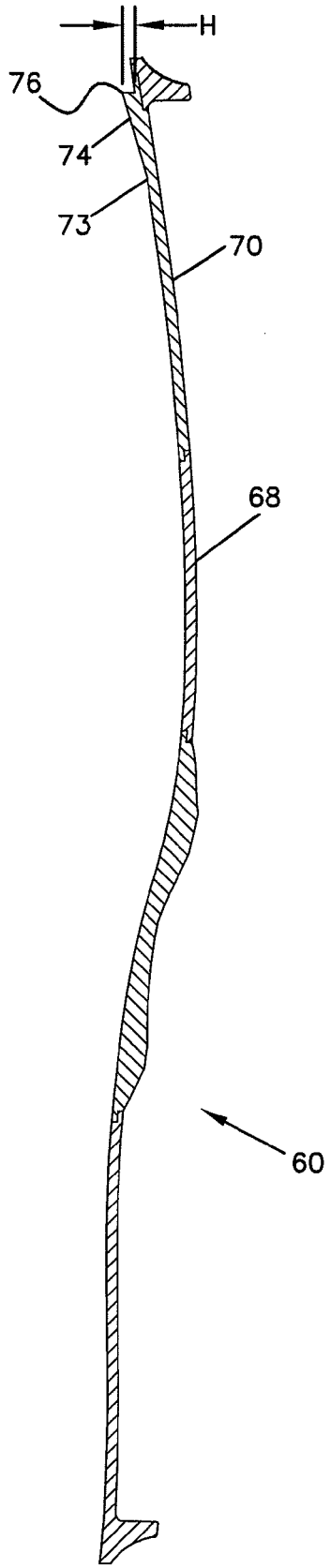
FIG. 13 is a longitudinal sectional view of the foot support platform of FIG. 12 at line 13-13.

In the depicted embodiment, the material used to mold the relatively flexible hindfoot zone 40 and the metatarsal support area 46 is thermoplastic polyurethane (TPU), the relatively stiffer material 50 used to mold a portion of the midfoot zone 44 and toe support area 48 is glass reinforced nylon (FIGS. 9 and 10). The construction of the midfoot zone 44 is at least ten percent stiffer than the construction of the hindfoot zone 40. The toe support area 48 is at least ten percent stiffer than the construction of the metatarsal support area 46. The toe support area 48 is at least ten percent stiffer than the construction of the hindfoot zone 40, and the midfoot zone 44 is at least ten percent stiffer than the metatarsal support area 46. In the depicted embodiment midfoot zone 44 is sufficiently stiff to prevent the midfoot from significant bending when a person stands on a ladder rung, the hindfoot zone 40 is sufficiently soft to conform to a person's heel, the metatarsal support area 46 is sufficiently flexible to allow the metatarsal area of the shoe to bend in use, and the toe support area 48 is sufficiently stiff to distribute the force applied from the toe covering to a larger area of the outsole 14. In the depicted embodiment the midfoot zone 44 includes an integrally molded dog bone shaped shank member that provides stiffness. In the depicted embodiment the transition between the zones (e.g., line 84) is wavy rather than straight and does not have abrupt corners. This construction avoids stress concentration at the transitions as a result of the bending of the platform and results in overlap between the zones in the longitudinal direction. It should be appreciated that many alternative constructions are possible, including transition with sharp corners, straight line transition, or overlaps in the vertical direction.

In the depicted embodiment the outsole 14 is a multi material type body that is directly connected to the upper 12. The outsole 14 includes a shock absorption portion 52 that is molded into the portion that is configured to engage the ground surface 54, otherwise referred to herein as the tread. In the depicted embodiment, the shock absorption portion 52 of the outsole 14 is molded to the pliable material 30 on the second surface of the foot support platform 18. In the depicted embodiment the shock absorption portion 52 is delivered into the cavity defined by the tread portion 54 and the bottom surface 24 of the foot platform 18. This step adheres the outsole 14 to the support platform 18, and thereby also connects the outsole 14 to the upper. In the depicted embodiment softer materials are molded into the heel areas 56 and the forefoot areas 58 of the shock absorption portion 52 of the outsole 14. In the depicted embodiment gel-like materials are molded in these areas. In some embodiments the softer materials are preformed and provided as inserts into the heel areas 56 and forefoot areas 58.

In an alternative embodiment, the tread portion of the outsole may be constructed of the same material that is used to construct the shock absorption portion. In such embodiments, the outsole 14 may still be directly connected to the upper via molding. In such an embodiment, molten outsole material would be provided in a cavity defined by a mold portion and the bottom surface 24 of the foot support platform 18.

It should be appreciated that the foot support platform 18 can also be used in construction where the outsole is indirectly attached to the upper. In such embodiments the outsole can be preformed. In such embodiments one surface of a midsole can be cemented to the bottom surface 24 of the foot support platform 18, and another surface of the midsole can be cemented to the outsole. In such an embodiment the welt can also be stitched to the foot support platform 18, the midsole, and the outsole.

Referring to FIGS. 11-14 an alternative embodiment of the foot support platform is shown. In the depicted embodiment the foot support platform 60 is similar to the support platform 18 as it also includes a hindfoot zone 62, a forefoot zone 64, and a midfoot zone 66. Moreover, the forefoot zone 64 includes a metatarsal support area 68 that is less stiff than a toe support area 70.

Figure 15A:
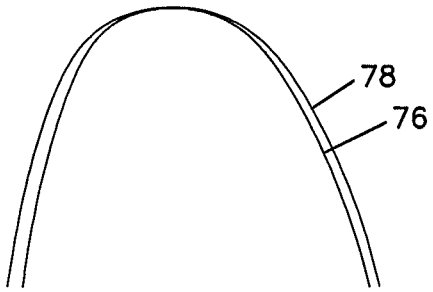
FIGS. 15A-B are schematic representations of the interface between a toe cap retaining structure and a toe cap flange.
Figure 15B:
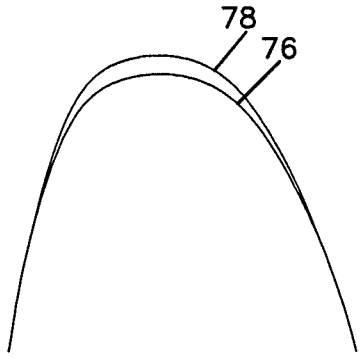

The support platform 60 further includes a toe cap retaining structure 72. In the depicted embodiment the toe cap retaining structure 72 includes a ramp 74 having a curved forward raised edge 76. In the depicted embodiment forward raised edge 76 is configured to engage a portion of a toe cap (e.g., a flange on the toe cap). In the depicted embodiment the raised edge 76 has a height H of about 1.0 mm. It should be appreciated that the height can vary from application to application (e.g., in another embodiment H could be between 0.5 mm and 5.0 mm). The raised edge defines the front arc shape of the ramp 74. The toe cap retaining structure 72 is configured to engage the toe cap wherein the toe cap has a different profile than the arc shape raised edge. For example, if the toe cap has a curvature that is greater than the radius of curvature of the ramp, the toe cap will engage the raised edge along the center line. See, for example, FIG. 15A. However, if the toe cap has a curvature that is less than the radius of curvature of the front of the toe cap, the toe cap will engage the raised edge on either side of the center line. See, for example, FIG. 15B. The configuration enables a certain size toe cap to fit with a variety of side support platforms.

In the depicted embodiment the ramp has a sloped profile that transitions the plane of the toe support area upward towards the upper surface of the flange 78 of the toe cap 80. See FIG. 14. In the depicted embodiment the ramp slopes upward from the upper surface of the platform in 180 degrees (both in the forward direction and towards each side). See FIG. 11 (see arc 73 identifying the location where the ramp begins to slope upward). In the depicted embodiment a securing layer 82 is cemented over the ramp 74 and the flange 78 of the toe cap to secure the toe cap 80 down on the platform 60. The securing layer can be, for example, a fibrous board material (e.g., Texon). It should be appreciated that the toe cap retaining structure 72 can have many different configurations. For example, alternatively, the toe cap retaining structure can be a raised rib with a squared off edge rather than a ramp shaped wedge, or the toe cap retaining structure can also be raised spaced apart posts. In addition, the toe cap retaining structure could also be a recess in the foot support platform. In the depicted embodiment the toe cap retaining structure 72 is molded integrally as part of the support platform 60. It should be appreciated that the toe cap retaining structure can be attached in many other ways (e.g., cemented, riveted, stitched, etc.).

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A welted footwear comprising:

an upper portion configured to hold the footwear to a person's foot, the upper portion including a lower peripheral edge;

a molded foot support platform including a first surface and a second surface, the foot support platform including a rib extending downwardly from the second surface adjacent a periphery edge of the foot support platform, wherein the rib is integrally molded to the foot support platform;

a welt configured to extend around at least a portion of the peripheral edge of the upper portion of the footwear;

a stitch that extends through at least a portion of the peripheral edge of the upper portion, the welt, and the rib of the foot support platform;

an outsole including a portion configured to engage the ground surface, the outsole including a portion that is attached to the foot support platform; and a pliable material molded to the rib such that a lower portion of the rib is on one side of the pliable material and an upper portion of the rib is on another side of the pliable material.

2. The welted footwear of claim 1, wherein the stitch that extends through the peripheral edge of the upper, the welt, and the rib also extends through the pliable material.

3. The welted footwear of claim 1, wherein a pliable material covers at least a portion of an exterior surface of the rib.

4. The welted footwear of claim 1, wherein the outsole is molded to the foot support platform.

5. The welted footwear of claim 4, wherein the outsole includes a shock absorption portion that is molded into a cavity between the portion of the outsole that is configured to engage the ground surface and the second surface of the foot support platform.

6. The welted footwear of claim 5, further comprising a pliable fabric material molded to the second surface of the foot support platform and wherein the shock absorption portion of the outsole is molded to the pliable fabric material.

7. The welted footwear of claim 1, wherein the foot support platform includes a hindfoot zone, a forefoot zone, and a midfoot zone, and wherein the foot support platform is at least ten percent stiffer in the midfoot zone than the hindfoot zone.

8. The welted footwear of claim 7, wherein the forefoot zone includes a toe support area and a metatarsal support area, wherein the metatarsal support area is between the toe support area and the midfoot zone, and wherein the toe support area of the foot support platform is at least ten percent stiffer than the metatarsal support area.

9. The welted footwear of claim 2, wherein at least some of the stitches extend through the pliable material on both an inner side portion and an outer side portion of the rib.

10. The welted footwear of claim 1, further comprises a toe cap retaining structure molded to the foot support platform.

11. A foot support platform comprising:

a main body including a first surface and a second surface;

a rib extending downwardly from the second surface adjacent a periphery edge of the main body, the rib being integrally molded to the main body;

a pliable material molded to the second surface and to at least a portion of the rib;

wherein the main body includes a hindfoot zone, a forefoot zone, and a midfoot zone;

wherein the foot support platform is at least ten percent stiffer in the midfoot zone than the hindfoot zone;

wherein the forefoot zone includes a toe support area and a metatarsal support area;

wherein the metatarsal support area is between the toe support area and the midfoot zone;

wherein the toe support area of the main body is at least ten percent stiffer than the metatarsal support area; and a ramp shaped toe cap retaining structure molded to the toe support area of the main body.

12. The foot support platform of claim 11, wherein the rib has an inside surface and an outside surface, wherein the outside surface has a curved cross-sectional profile.

13. The foot support platform of claim 11, wherein the pliable material is located on both an inner side portion and an outer side portion of the rib and wherein the pliable material includes fabric.

14. The foot support platform of claim 11, wherein the rib includes notches in a forefoot portion.

15. A footwear comprising:

an upper;

an outsole below the upper;

a foot support platform connected above the outsole, wherein the foot support portion includes a toe cap retaining structure having a raised edge;

a protective toe cap supported on the foot support platform and engaged with the raised edge of the toe cap retaining structure.

16. The footwear of claim 15, wherein the toe cap retaining structure is ramp shaped and integrally molded to the foot support platform.

17. The footwear of claim 15, wherein the front edge of the toe cap retaining structure defines an arc shape.

* * * * *